United States Patent [19]

Prouty

[11] Patent Number: 4,779,289

[45] Date of Patent: Oct. 25, 1988

[54] WORK GLOVE WITH INSERT

[76] Inventor: Ronald L. Prouty, 893 Ivy St., Eugene, Oreg. 97404

[21] Appl. No.: 134,999

[22] Filed: Dec. 18, 1987

[51] Int. Cl.[4] ..... A41D 19/00

[52] U.S. Cl. ..... 2/161 R; 2/159

[58] Field of Search ..... 2/161 R, 161 A, 158, 2/159, 163, 169

[56] References Cited

U.S. PATENT DOCUMENTS

| | | | |
|---|---|---|---|
| 709,595 | 9/1902 | Carson . | |
| 945,818 | 1/1910 | Sprague . | |
| 1,554,291 | 9/1925 | Peck . | |
| 1,673,517 | 6/1928 | Kurz . | |
| 1,984,183 | 12/1934 | Gillespie | 2/159 |
| 2,040,137 | 5/1936 | Jensen | 2/161 |
| 2,096,412 | 10/1937 | Sturm | 2/161 R |
| 2,582,240 | 1/1952 | Dumas | 2/161 |
| 3,643,386 | 2/1972 | Grzyll | 51/391 |
| 3,739,400 | 6/1973 | Colehower | 2/161 |
| 4,051,552 | 10/1977 | Widdemer | 2/161 A |
| 4,651,350 | 3/1987 | Dawiedczyk | 2/158 |

*Primary Examiner*—Louis K. Rimrodt
*Assistant Examiner*—J. L. Olds
*Attorney, Agent, or Firm*—James D. Givnan, Jr.

[57] ABSTRACT

Work glove construction embodied in a glove for wear on either hand and having a cut-out area in the thumb index finger crotch area. A pliable, wear resistant insert is secured in place interiorly of the glove in the crotch area. The insert is equally disposed on both sides of a glove medial plane to enable wear on both hands with protection of the thumb, index finger and side of both hands.

6 Claims, 1 Drawing Sheet

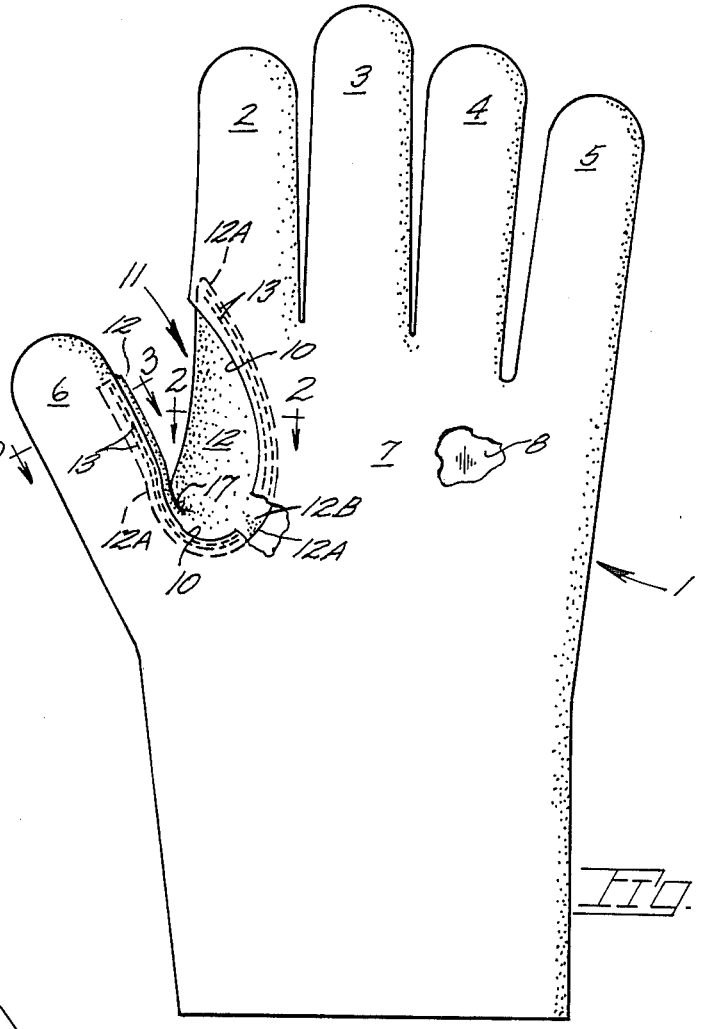
FIG. 1
FIG. 3
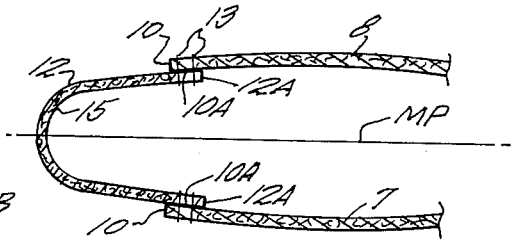
FIG. 2
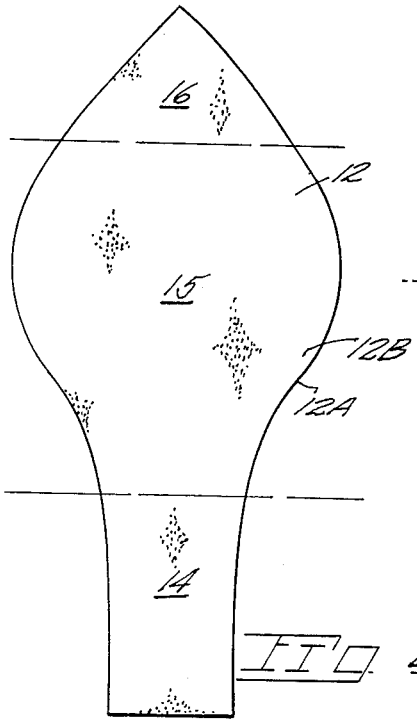
FIG. 4

WORK GLOVE WITH INSERT

BACKGROUND OF THE INVENTION

The present invention pertains generally to work gloves for industrial use and other gloves subjected to severe use.

The prior glove art discloses various types of glove construction with provision made for reinforcing a glove at points subjected to rapid wear. Typically such reinforcement is by the use of abrasion resistant material applied to the glove exterior. Unreinforced gloves may wear out in two or three work shifts in certain industries. The addition of a patch, so to speak, of wear resistant material ofttimes hinders glove flexibility. Secondly, the addition of wear resistant material to a portion of the glove exterior renders a seam susceptible to snagging on the workpiece being handled. Such snagging can contribute a risk of injury particularly in a work place where the workpieces must be lifted from a fast moving conveyor such as that type of conveyor used in a sawmill to transfer boards from a saw to a sorting area. Boards must be grasped and lifted from the conveyor means. Any hole or tear in the glove presents a risk of hand injury by penetration of a splinter. Accordingly, work gloves used in the off loading of board conveyors must be discarded upon any sort of glove hole or tear occurring at considerable expense to the worker when calculated over a period of two or three weeks. The practice of discarding work gloves when a failure occurs in a localized area of the glove is extremely wasteful. Attempts in the past to reinforce heavy duty work gloves have contributed to undesired glove stiffness.

SUMMARY OF THE PRESENT INVENTION

The present invention is embodied in a glove having an insert affixed interiorally to the thumb-finger crotch area of the glove.

The present glove is adapted for wear on both hands for greater utilization of same by permitting glove use on the remaining hand of the user with the wear resistant insert being positioned so as to protect those areas of the hands most susceptible to injury i.e., the thumb-finger crotch areas. The insert edge is concealed within the glove to avoid risk of snagging and tearing by a moving workpiece which must be lifted from a conveyor. The insert serves to protect the thumb, adjacent edge of the palm of the hand and the proximal portion of the first phalanx of the first (or index) finger.

Important objectives of the present glove include the provision of a glove for use when lifting highly abrasive workpieces such as rough cut boards carried on a rapidly moving conveyor running from a saw to a sorting site; the provision of a glove having a reinforcing insert which does not diminish the pliable nature of the glove; the provision of a glove with symmetrical internal insert for use on either hand to double glove life and to protect those parts of the hand most susceptible to injury.

BRIEF DESCRIPTION OF THE DRAWINGS

In the accompanying drawings:

FIG. 1 is a plan view of a glove embodying the present invention with the unseen side of the glove being a mirror image of the side shown;

FIG. 2 is a horizontal sectional view taken along line 2—2 of FIG. 1; and FIG. 3 is an inclined sectional view taken along line 3—3 of FIG. 1; and FIG. 4 is a plan view of the present insert removed from the glove.

DETAILED DESCRIPTION OF THE PREFERRED EMBODIMENT

With continuing attention to the drawings, the reference numeral 1 indicates generally a glove of the type worn by industrial workers.

Glove finger stalls are at 2, 3, 4 and 5 with stall 2 receiving the first or index finger. A thumb stall is at 6.

A palm 7 of the glove is interchangeable with a back 8 of the glove such being accomplished by removal and inverting of the glove preparatory to inserting the remaining hand of the user.

The palm 7, back 8, thumb stall 6 and first finger stall 2 are cut away to form an edge 10 defining a thumb-finger crotch cut-out area generally at 11 in which an insert 12 is disposed. Insert 12 is of irregular shape having a concealed edge 12A. A margin 12B of the insert is secured to a glove inner margin lOA by stitching 13 or other suitable securement means. Portions of the insert, defined by phantom lines, may be identified as follows: a thumb portion 14, a palm-back portion 15 and a first finger portion 16. Accordingly, those portions of the user's thumb, palm-back and first finger defining the thumbfinger crotch area are protected by the insert which preferably is of tough yet pliable leather or other like material more abrasion resistant than the remainder of the glove. The insert 12 is symmetrically disposed with respect to a medial plane MP of the glove.

Glove use in the sorting of sawn lumber will cause the glove to wear unevenly with respect to the users' hand i.e., the insert will wear through in that area of the insert nearest the glove palm. Transfer of the glove to the remaining hand will locate the worn area of the insert proximate the back of the hand whereat it is removed from possible contact with the workpiece and specifically removed from permitting entry of a workpiece fragment or sliver. As viewed in FIG. 1, the insert has a fold line or crease at 17 along which flexing of the insert occurs. Such a fold line occurs from the inherent shape of the insert when same is stitched in place within the glove cut-out area defined by continuous edge 10.

While I have shown but one embodiment of the invention, it will be apparent to those skilled in the art that the invention may be embodied still otherwise without departing from the spirit and scope of the invention.

Having thus described the invention, what is desired to be secured in a Letters Patent is:

1. Work glove construction comprising, palm and back members, finger stalls and a thumb stall integral with said members, said thumb stall and one of said finger stalls and said members having a continuous edge defining a thumb-finger crotch cut-out area, and a pliable insert of wear resistant material having an outer margin and occupying said cut-out area, means attaching said outer margin to the interior surfaces of said palm and back members and said thumb stall and said one of said finger stalls whereby the edge of said insert will be isolated from contact with a workpiece coming into contact with the glove.

2. The work glove claimed in claim 1 wherein said palm and back members are mirror images of one another to render the glove equally adaptable to use on either hand.

3. The work glove claimed in claim 1 wherein said insert is of irregular shape having a first finger, thumb and palm-back portions.

4. In a glove having palm and back members with finger stalls and a thumb stall integral with said members, the improvement comprising, a continuous edge on said members and one of said finger stalls and said thumb stall, said edge defining a cut-out area, an insert in place in said area and having a margin suitably secured to the interior of the glove.

5. The improvement claimed in claim 4 wherein said insert includes a palm-back portion for partially overlying the palm and back of a hand during glove use.

6. The improvement claimed in claim 4 wherein said insert is symmetrically disposed relative a medial plane of the glove to render the glove suitable for protective wear on either hand.

* * * * *